US006170384B1

(12) United States Patent
Stoll et al.

(10) Patent No.: US 6,170,384 B1
(45) Date of Patent: Jan. 9, 2001

(54) FLUID POWER ROTARY DRIVE DEVICE

(75) Inventors: Kurt Stoll, Esslingen; Albrecht Wagner, Winterbach; Dietmar Pfeiffer, Esslingen, all of (DE)

(73) Assignee: Festo AG & Co., Esslingen (DE)

( * ) Notice: Under 35 U.S.C. 154(b), the term of this patent shall be extended for 0 days.

(21) Appl. No.: 09/229,791

(22) Filed: Jan. 13, 1999

(30) Foreign Application Priority Data

Jan. 31, 1998 (DE) ..... 198 03 819

(51) Int. Cl.[7] ..... F15B 15/26
(52) U.S. Cl. ..... 92/22; 92/68; 92/136
(58) Field of Search ..... 92/22, 62, 68, 92/136

(56) References Cited

U.S. PATENT DOCUMENTS 3,019,771 * 2/1962 Heese et al. ..... 92/136
3,958,493 * 5/1976 Fujita et al. ..... 92/62

FOREIGN PATENT DOCUMENTS 37 41 261 A1 7/1988 (DE) .
0 449 803 A1 10/1991 (EP) .
2 138 505 10/1984 (GB) .
63-19408 1/1988 (JP) .
2-60704 5/1990 (JP) .
3-121201 12/1991 (JP) .
4-101809 9/1992 (JP) .
5-223106 8/1993 (JP) .
172167 * 6/1965 (SU) ..... 92/68

* cited by examiner

*Primary Examiner*—F. Daniel Lopez
(74) *Attorney, Agent, or Firm*—Hoffman & Baron, LLP

(57) ABSTRACT

A fluid power rotary drive device, which possesses two oppositely moving drive pistons and an output drive part in mesh with the same. With the aid of a position presetting means it is possible to preset an intermediate position of the output drive part. For this purpose an abutment unit is provided, which has two abutment parts arranged as an axial extension of the two drive pistons. The abutment unit is able to be moved relatively to the drive piston into a positioning setting, in which the two abutment parts are both in engagement with the respectively associated drive piston, something which corresponds to the desired intermediate position.

19 Claims, 3 Drawing Sheets

FLUID POWER ROTARY DRIVE DEVICE

BACKGROUND OF THE INVENTION

The invention relates to a fluid power rotary drive device comprising a rotatably mounted output drive part, which has at least one ring of teeth, with which rack means, arranged on two juxtaposed drive pistons, are in engagement, the drive pistons being adapted to be oppositely moved by fluid actuation in two mutually parallel directions in order to cause a rotary movement of the output drive part between two end positions.

THE PRIOR ART

Owing to the presence of two drive pistons rotary drive of this type are referred to as double piston rotary drives. Their output drive part, which is generally designed in the form of a solid or hollow shaft, extends through and between the two drive pistons, with which it is engaged by gear teeth at a diametrally opposite peripheral position. By means of suitable fluid actuation it is possible for the drive pistons to be driven to perform an oppositely directed linear movement, something which in accordance with the selected direction of travel results in rotary clockwise or counter-clockwise movement. The angular displacement of the output drive part between the two end positions may be more or less than 360° in accordance with the maximum possible movement of the drive pistons.

SHORT SUMMARY OF THE INVENTION

A disadvantage in the case of rotary drive devices known to the assignee is the absence of any possibility of presetting intermediate positions of the output drive part. This means that the field of application is limited to certain uses. Accordingly the present invention is to provide a rotary drive device of the type initially mentioned which renders possible a positioning of the output drive part between the two end positions.

In order to achieve these and/or other objects appearing from the present specification, claims and drawings, in the present invention a position presetting device is provided, which by cooperation with the two drive pistons renders possible the presetting of an intermediate position, between the end positions, of the output drive part and for this purpose possesses an abutment unit having two abutment parts arranged adjacent to each other in an axial extension of the two drive pistons, such abutment unit being adapted to be moved in relation to the drive pistons into a positioning setting, in which the two abutment parts are simultaneously in contact with the respectively associated drive piston.

It is in this manner that the output drive part may be positioned not only in the two end positions but also in at least one intermediate position so that the rotary drive device has more extensive field of application. Because the position presetting means cooperates with the drive pistons, the toothed engagement between the output drive part and the drive pistons is not subjected to any higher load than in the case of a conventional design. The desired intermediate position may be simply set by displacing the abutment unit so far toward the drive piston that each drive pistons engage one of the abutment parts which are fixedly joined together. Owing to the existence of the toothed engagement there is therefore a closed force circuit, which renders possible a play-free fixation of the output drive part in the preset intermediate position.

Further advantageous developments of the invention are defined in the claims.

It is convenient for the abutment unit to be able to be shifted between the positioning setting and a home position, which is outside the maximum possible axial travel of the drive piston, the drive pistons in the home position of the abutment unit being able to be so positioned in their end positions by the action of pressure that the output drive part assumes the respectively associated end position.

It is convenient for the abutment unit to be located, when in the home position, outside the piston receiving spaces for the drive pistons, whereas in the positioning setting it has both abutment parts extending simultaneously axially into the two piston receiving spaces.

Preferably the rotary drive device so designed that a displacement of the abutment unit is possible using fluid force. For this purpose the abutment unit may have an actuating piston connected with the two abutment parts, which piston is acted upon by compressed air, for instance, for causing displacement. In order to be able to produce a compact design with a low height, it is an advantage for the actuating piston to have an elongated outline so that it is may be termed a flat piston.

The abutment parts are preferably designed like plungers and run in parallelism to one another so as to represent a coaxial extension of the respectively associated drive piston. They may be arranged with a transverse spacing between them on the common associated actuating piston. The fluid operation of the actuating piston may selectively be in accordance with a single acting or a double acting fluid power cylinder.

More particularly in order to permit fine adjustment of the intermediate position desired, it is possible for one or both of the abutment parts to have an abutment element, which may be adjusted in the direction of travel of the associated drive piston. In order, using simple means, to permit subsequent adjustment, it is possible for the abutment unit to have one or more cavities, which from the outside render possible an adjustment of the respective abutment element using a suitable tool such as a screwdriver or wrench.

It is furthermore an advantage if on leaving the positioning setting of the abutment unit there is an effective choking of spent air. This renders possible controlled movement of the abutment unit, when the output drive part is moved out of the intermediate position, jitter being avoided.

If the abutment unit is provided with at least one actuating member cooperating with a position sensor, there is the possibility of detecting the intermediate position reached by the output drive part via the abutment unit.

By mutual matching of the length of the abutment parts and of the drive pistons and their relative associations it is possible to select the intermediate position, which is to be preset, practically anywhere between the two end positions. An arrangement which appears to be particularly convenient is the presetting of a middle position, in the case of which the angular position assumed by the output drive part amounts to half the angle between the two end positions.

In the following the invention will be described with reference to the accompanying drawing in detail.

LIST OF THE SEVERAL VIEWS OF THE FIGURES

Figure 5:
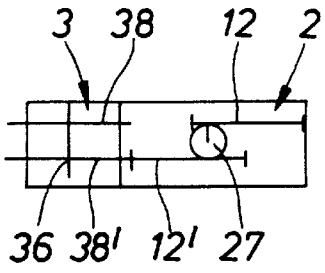
Figure 6:
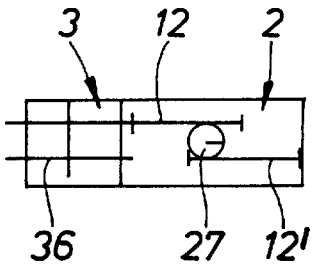
Figure 7:
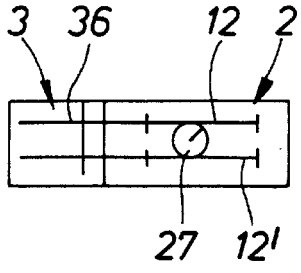

FIGS. 5 to 7 diagrammatically show different possible operating states of the rotary drive device.

DETAILED ACCOUNT OF WORKING EMBODIMENT OF THE INVENTION

The rotary drive device generally referenced 1 in the drawings comprises a drive module 2 and a positioning module 3 detachably but securely connected with same. The general structure of the drive module 2 may be according to the prior art and the novelty as such of the invention is in relation to the positioning module 3 and its cooperation with the drive module 2.

The drive module 2 contains a first longitudinal housing 4, preferably with a cube-like outline. As regards details, it has an elongated base section 5, which in the longitudinal direction has two adjacently placed piston receiving spaces extending through it. The piston receiving spaces 6 and 6' are closed at one axial end in a sealing manner by a terminating cover 7 to the rear on the base section 5. The opposite front closure is ensured by the positioning module 3, whose housing, in what follows referred to as the second housing 8, is placed on the front end side of the base section 5 and is secured by means of screws, which are not illustrated in detail.

In each piston receiving space 6 and 6' there is a drive piston 12 and 12' guided for motion in the longitudinal direction. Each drive piston 12 and 12' has rack means 13 and 13' extending in its longitudinal direction, the teeth thereof extending athwart and preferably at a right angle to the longitudinal axes 14 and 14' of the piston receiving spaces 6 and 6'. In the working embodiment the rack means 13 and 13' are on rack elements 15 and 15', which are connected together axially on each side with a respective piston head 16, which carries an annular seal 17 cooperating with the internal face of the associated piston receiving space 6 and 6'.

Each piston receiving space 6 and 6' is divided up by a drive piston 12 and 12' located in it into two working spaces 18, 19; 18' and 19'. Via fluid ducts 22 the working spaces communicate with connection openings 23, located more particularly on the terminating cover 7, with the external side of the first housing 4 and through such openings a driving fluid, more particularly compressed air, may be fed and let off as needed.

The arrangement is preferably such that the front working space 18 and 18' nearer the positioning module 3, of each piston receiving space 6 and 6' is in communication with the rear working space 19 and 19' of the respectively other piston receiving space, the paired communicating working spaces possibly having a common associated connection opening 23, which via diagrammatically indicated fluid power lines 24 is in communication with a first control valve means 25 of the working example. The first control valve means 25 of the working example is designed in the form of a 4/3 way valve, which in the illustrated neutral position vents all working spaces 18, 19; 18' and 19' to the surroundings R. In the two further possible positions of switching the working spaces are so connected for the action of pressure medium and, respectively, vented that the drive pistons 12 are moved synchronously in opposite directions and in mutual parallelism to each other along the longitudinal axes 12 and 12'. In the case of a forward movement of the one drive piston the other drive piston consequently performs a rearward movement The linear movements of the drive pistons 12 and 12' are converted into a rotary movement, as indicated by the double arrow 26, of an output drive part 27. This output drive part 27 possesses a shaft-like output drive section 28, which in the embodiment is continuous and hollow, extending in the intermediate space between the facing rack means 13 and 13' of the drive pistons 12 and 12' and extends through, and more especially completely through the first housing 4. Its longitudinal axis 32 extends at a right angle and at the same time parallel to the planes of the rack means 13 and 13'. It simultaneously constitutes the axis of the rotation of the output drive part 27, which is rotatably mounted on the first housing 4 with the aid of suitable bearing means 33.

The region of the output drive section 28 between the rack means 13 and 13' is provided on its outer periphery with a ring 34 of teeth, which is preferably without any gap, such ring being keyed on the periphery, such ring simultaneously being in engagement with diametrally opposite points of the two rack means 13 and 13' of the drive pistons 12 and 12'.

The above mentioned linear motion of the two drive pistons 12 and 12' accordingly results in a rotary movement of the output drive part 27 about the axis 32 of rotation, the direction of the rotation being dependent on the direction of the displacement of the drive pistons 12 and 12'. Dependent on the lengths of the rack means 13 and 13' and dependent on the maximum possible axial displacement of the drive pistons 12 and 12' it is possible to have angular displacements of the output drive part 27, which are less than or geater than 360° and may certainly amount to a multiple of 360°.

Attachment means 35 provided on the output drive part 27 outside the first housing 4 render possible the setting in position of components which are to be turned or pivoted, as for instance a gripping means employed for handling workpieces.

The drive module 2 is provided with a position presetting means in the form of the positioning module 3, which by cooperation with the two drive pistons 12 and 12' renders possible the setting of an intermediate angular position of the output drive part 27 in relation to the first housing 4, the intermediate position being between the angular end positions, which the output drive part 27 assumes, when the drive pistons 12 and 12' reach the one or the other of their two possible axial end positions. These end positions may more particularly be defined by the drive pistons 12 and 12' coming into engagement with an abutment face on the cover.

As regards details the position presetting means or module 3 possesses an abutment unit 36, placed in front of the drive pistons 12 and 12' axially and which is able to be displaced in parallelism to the directions of displacement of the drive pistons 12 and 12' in relation to the above mentioned parts. It is mounted slidingly in the second housing 8 and possesses two abutment parts 38 and 38', which are arranged a certain distance apart and parallel to one another in alignment with the two drive pistons 12 and 12' as an axial extension thereof. On its end face turned toward the piston receiving space 6 and 6' each abutment part 38 and 38' possesses an abutment face 42 and 42', which is axially opposite to a counter-abutment face 43 and 43', such counter-abutment face being located on the end face of the axially drive sequence piston 12 and 12'.

Figure 1:
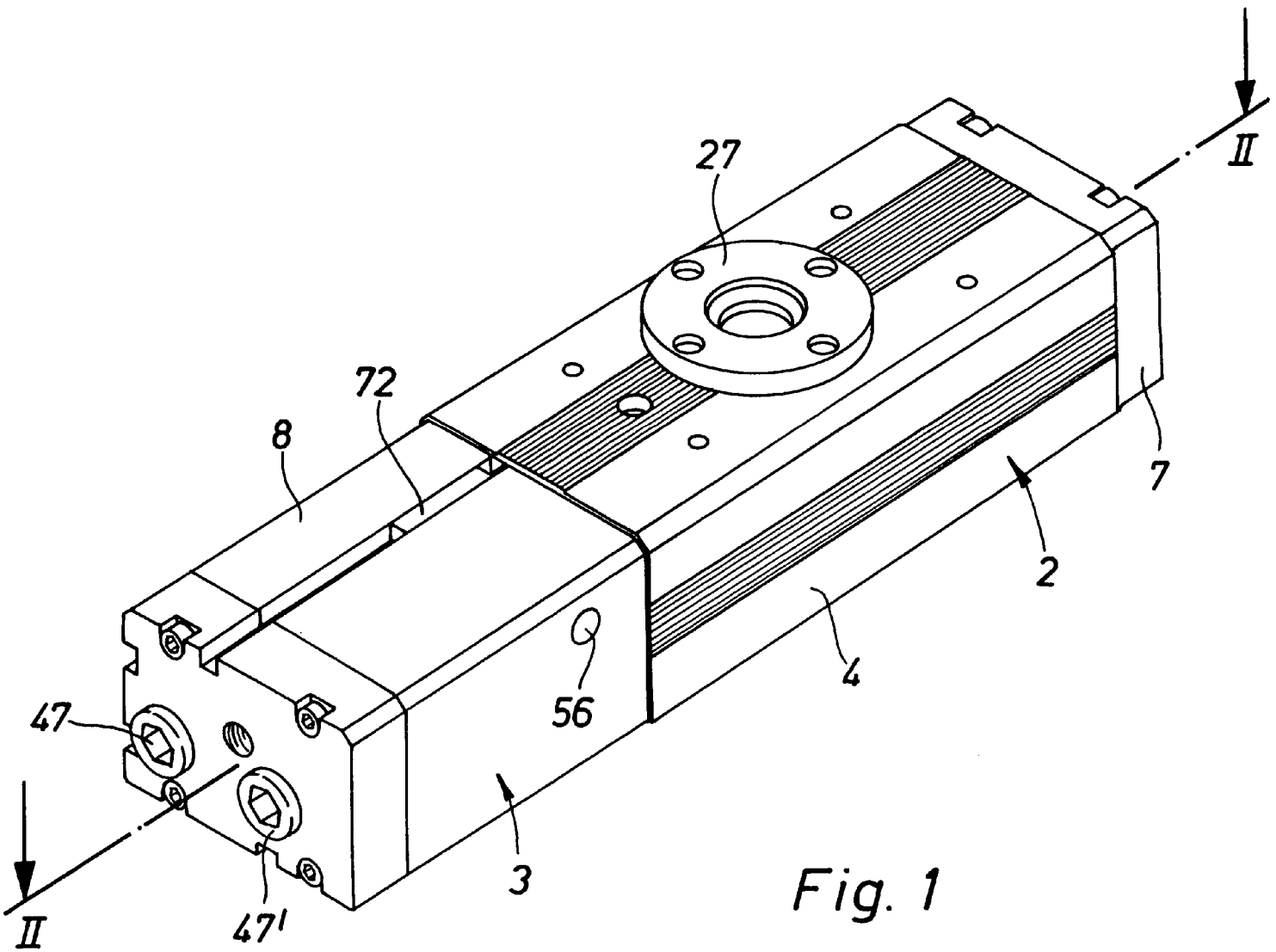
FIG. 1 shows a preferred structural configuration of the rotary drive device of the invention in a perspective elevation.
Figure 2:
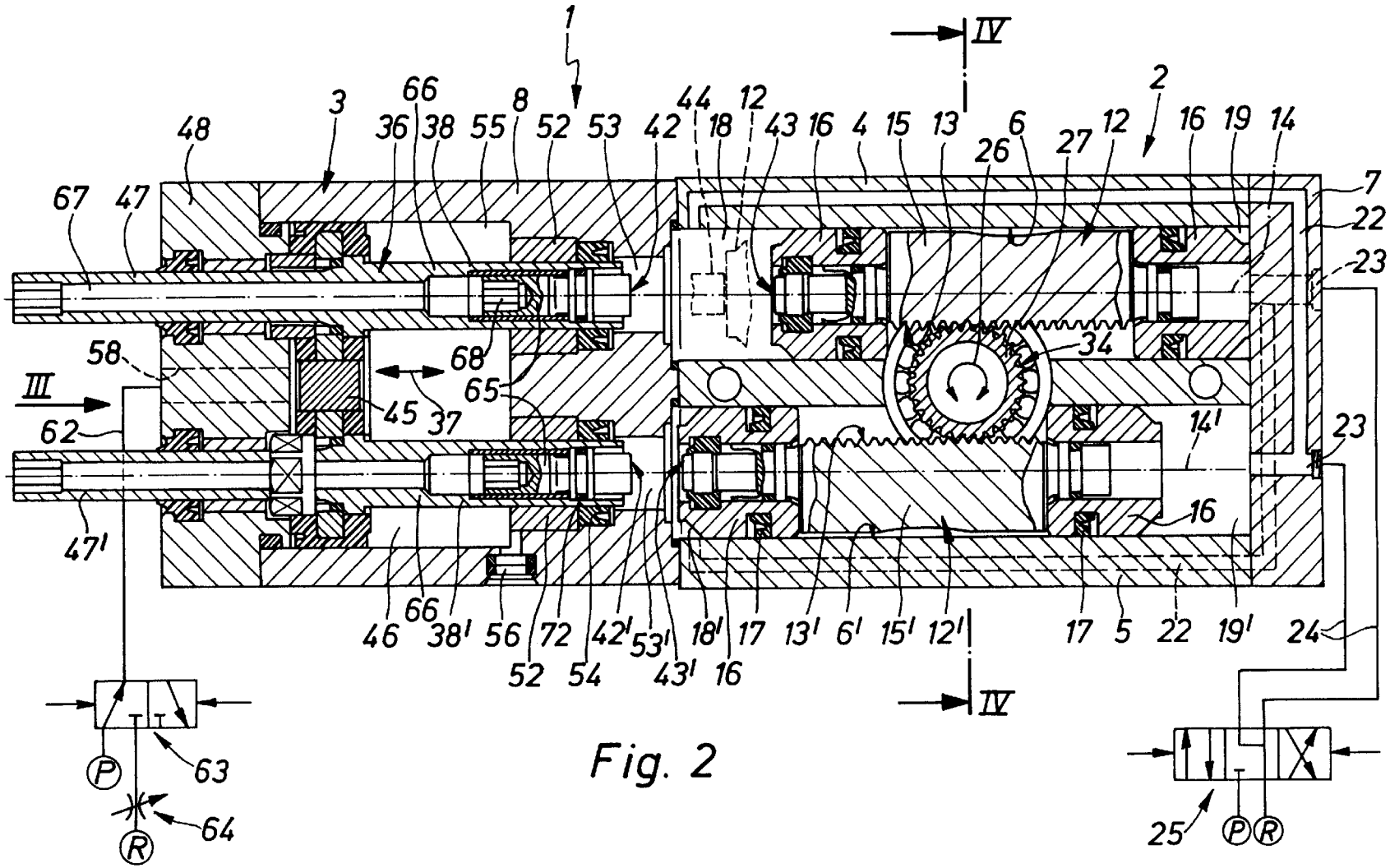
FIG. 2 shows a longitudinal section taken through the rotary drive device on the line II—II of FIGS. 1 and 4

In the working embodiment the abutment unit 36 is able to be shifted by fluid force between the home position depicted in FIG. 2 and a positioning setting relatively displaced toward the drive module 2. In the home position the abutment faces 42 and 42' are outside the maximum possible axial displacement of the drive pistons 12 and 12', same being preferably moved into the second housing 8. In the positioning setting the two abutment parts 38 and 38' project axially into the adjacent piston receiving space 6 and 6' and assume the position indicated in FIG. 2 with reference to the one abutment part. This positioning setting 44 is characterized in that both abutment parts 38 and 38' simultaneously have their abutment faces 42 and 42' in engagement with the counter-abutment face 43 and 43' of the axially adjacent drive piston 12 and 12'. This means that the two drive pistons 12 and 12', which are kinematically coupled owing to the engagement of the rack means 13 and 13', are axially braced without the possibility of motion and the result is then a play-free location of the output drive part 27 in the intermediate position then existing.

Starting with the end position as illustrated of the drive pistons 12 and 12' the displacement of the abutment unit 36 in the positioning setting is best brought about with the first valve means 25 located in the neutral position. The drive piston 12, which is first acted upon by an abutment part 38', is then moved back, something which, owing to the toothed engagement, results in a ganged movement of the other drive piston 12, which then moves closer to the second abutment part 38, which for its part is drawing nearer. The positioning setting is reached, when the forwardly moving drive piston 12 runs up against the associated abutment part 38, the corresponding position being indicated in chained lines in FIG. 2.

The present intermediate position existing in the embodiment in the positioning setting, of the output drive part 27 is a center position, which angularly is in the middle between the two end or extreme positions. In order to make this clear FIGS. 5 and 6 indicate the end positions adopted in the home position of the abutment unit 36, between which end positions in the embodiment there is an angular displacement of 90°. In FIG. 7 the same arrangement is illustrated with the abutment unit 36 shifted into the positioning setting, the output drive part 27 assuming a 45° center position. This is achieved in the embodiment because the drive pistons 12 and 12' and the meshing engagement are so matched to one another that in the intermediate position the two counter-abutment faces 43 and 43' lie in a plane extending at a right angle to the longitudinal axes 14 and 14', the abutment faces 42 and 42' on the abutment unit 36 also being in a common plane perpendicular to the longitudinal axes 14 and 14'.

It will be apparent that for example by producing an axial offset between the two abutment faces 42 and 42' an intermediate position, departing from the center position, may be assumed.

Figure 3:
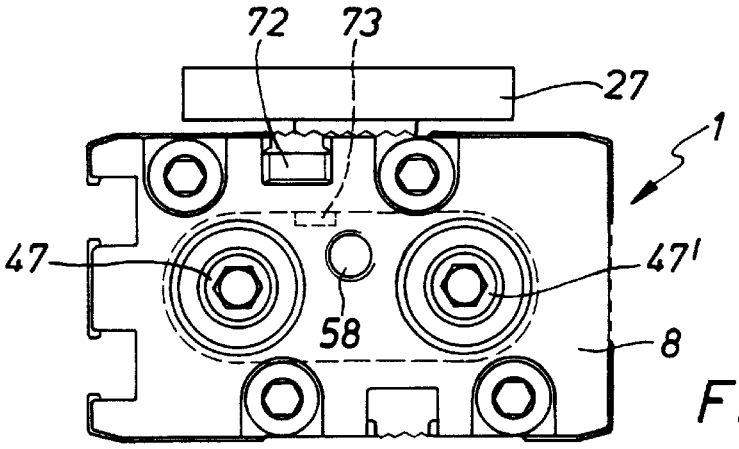
FIG. 3 shows an end-on view of the rotary drive device looking in the direction of the arrow III in FIG. 2.
Figure 4:
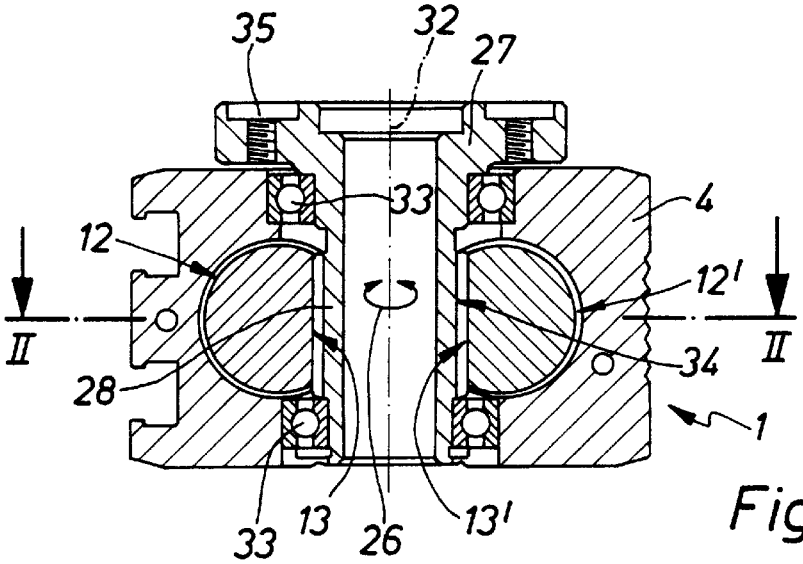
FIG. 4 shows a cross section taken through the rotary drive device on the section line IV–IV of FIG. 2.

For its operation in the embodiment the abutment unit 36 is provided with an drive piston 45, which is located in a further piston receiving space 46, formed in the second housing 8 and is able to be displaced in the displacement direction 37. In order to produce a configuration of the device which is compact in the direction of the axis of rotation, the actuating piston 45 is designed with an elongated outline as a flat piston, which in cross section possesses an elongated shape. In the embodiment of the invention it will be from FIG. 3 that it possesses plane longitudinal sides, which are connected by rounded narrow sides with each other. An oval or for instance elliptical outline would also be possible. The two abutment parts 38 and 38' are designed play like plungers, same being connected in a coaxial extension of the respectively associated drive piston 12 and 12' permanently with the actuating piston 45. In the illustrated working embodiment the connecting regions are at the sections on the narrow side of the actuating piston 45.

As a coaxial extension of the abutment parts 38 and 38' and on the axial side facing away from the drive pistons 12 and 12' the abutment unit 36 possesses two bearing rods 47 and 47', which extend with sliding engagement axially through the terminating wall 48, which is axially opposite to the drive module 2, of the second housing 8. In the zone of such sliding engagement guiding and sealing means are provided. The rod-like abutment parts 38 and 38' are also guided on the housing side, (for which purpose suitable guide means 52 are provided), conveniently in the openings 53 and 53' through which the abutment parts 38 and 38' extend, which openings 53 and 53' connect the further piston receiving space 46 respectively with one of the two other piston receiving spaces 12 and 12'. In the openings 53 and 53' there is furthermore an annular sealing means 54, which produces a sealing effect between the second housing 8 and the associated abutment part 38 and 38' and prevents fluid access between the front working spaces 18 and 18' of the drive module 2 and the rear working space 55 of the further piston receiving space 46. The positioning module 3 is designed on the lines of a single acting fluid power cylinder, the rear working space 55 being vented via a duct 56 in the housing at all times. The front working space 57 placed on the other side of the actuating piston 45 on the other hand communicates via a connection opening 58, which extends through the second housing 8, and a pressure medium duct 62 connected thereto with a second control valve means 63. In the working embodiment it is constituted by a 3/2 way valve, connects the front working space 57 collectively by a pressure medium source P or with the surroundings R.

In order to shift the output drive part 27 into its intermediate position the front working space 57 is charged with compressed air, the first control valve means 25 being in the neutral position, so that the actuating piston 45, which is acted upon, shifts the abutment parts 38 and 38' in the above mentioned manner out of the home position into the positioning setting.

In order to then shift the output drive part 27 back into one of its two end positions, the second switching valve means 63 is shifted into the venting position and the first control valve means 25 is switched over into one of the two other switching positions. This means that the abutment unit 36 is returned to its home position by the actuation on the part of one of the drive pistons 12 and 12'. In order to ensure that then there is no violent return impact of the abutment unit 36, an adjustable choke means 64 is provided in the duct section following the second control valve means 63, such choke means causing a throttling effect on the spent air and hence a retarded escape of the displaced pressure medium.

It will be clear that the positioning module 3 may also be designed in the form of a double acting fluid power cylinder in order to be able to cause the return motion of the abutment unit 36 into the home position in a fashion independent of the state of actuation of the drive module 2.

In order to be able to exactly set the desired intermediate position in the embodiment the two abutment faces 42 and 42' are provided on two abutment elements 65, which respectively are so adjustably mounted on a tube-like base 66 of the abutment unit 36 that they can be steplessly reset in the direction of displacement of the drive pistons 12 and 12'. Preferably, the abutment elements 65 are designed like bolts and provided with an external screw thread, using which same can be screwed into the tube-like base 66. This tube-like base 66 is, in the present working example of the invention, made integrally with the bearing rod 47, which is hollow, so that the result is an access duct 67, which extends through the abutment part 38 and 38' and the associated bearing road 47 and 47', and which renders possible an access to the associated abutment element 65 from outside the second housing 8. It is in this manner that an elongated screwing tool may be introduced and applied to the engagement region 68 on the abutment element 65 in order to screw the abutment element 65 in an axial direction and to set it as may be desired. In the working embodiment here adjustments of +/−10° are possible.

An annular seal 72 located between the abutment element 65 and the base 66 serves to prevent escape of pressure medium through the access duct 67.

The rotary drive device 1 renders possible, in the described form of embodiment, a simple detection of the intermediate position set using the position presetting means 3. For this purpose a position sensor 72 is provided on the second housing 8, which sensor is actuated by an actuating member 73, provided on the abutment unit 36, on reaching the positioning setting without mechanical contact.

Owing to the modular design the position presetting means 3 can be mounted on various different drive modules and more particularly renders possible upgrading of existing drive modules.

What is claimed is:

1. A fluid power rotary drive device comprising:

a rotatably mounted output drive part, having at least one ring of teeth, a rack arranged on two juxtaposed drive pistons and being in engagement with the output drive part, the drive pistons being adapted to be oppositely moved by fluid actuation in two mutually parallel directions in order to cause a rotary movement of the output drive part between two end positions, and a position presetting device adapted to cooperate with the two drive pistons to permit presetting of an intermediate position of the output drive part, the position presetting device including an abutment unit having two abutment parts that are mechanically linked so that they move in unison with each other and are positioned adjacent to each other in an axial extension of the two drive pistons, the abutment unit being adapted to be moved in relation to the drive pistons into a positioning setting in which the two abutment parts are simultaneously in contact with the respectively associated drive piston.

2. The rotary drive device as set forth in claim 1, wherein in the positioning setting the two abutment parts are in engagement with a axially directed end face of the respectively associated drive piston.

3. The rotary drive device as set forth in claim 1, wherein in the positioning setting the abutment unit has the two abutment parts extending axially into a piston receiving space, which is adapted to receive the associated drive piston in a sliding manner.

4. The rotary drive device as set forth in claim 1, wherein the abutment unit is able to be shifted between the positioning setting and a home position which is placed outside the maximum possible axial displacement of the drive pistons.

5. The rotary drive device as set forth in claim 1, wherein the direction of displacement of the abutment unit extends in parallelism to the direction of motion of the drive pistons.

6. The rotary drive device as set forth in claim 1, wherein the abutment unit is placed axially preceding the drive pistons.

7. The rotary drive device as set forth in claim 1, wherein the abutment unit is adapted to be moved by fluid power.

8. The rotary drive device as set forth in claim 1, comprising a spent air throttling means which becomes effective on leaving the positioning setting of the abutment unit.

9. The rotary drive device as set forth in claim 1, wherein the drives are positioned in a first housing and the abutment unit is positioned in a second housing, and said first housing and said second housing are arranged in an end to end configuration.

10. The rotary drive device as set forth in claim 1, wherein the preset intermediate position is a center position in the middle between the two end positions of the output drive part.

11. The rotary drive device as set forth in claim 1, wherein the abutment parts are designed in the form of plungers and more especially are arranged as a coaxial extension of the respectively associated drive piston.

12. The rotary drive device as set forth in claim 11, wherein the abutment unit possesses two bearing rods arranged as a coaxial extension of the abutment parts.

13. The rotary drive device as set forth in claim 1, wherein at least one of the abutment parts possesses an abutment element bearing an abutment face cooperating with the associated drive piston, said abutment element being supported on a base and movable in relation to the base in the direction of displacement of the associated drive piston to provide adjustability to the intermediate position.

14. The rotary drive device as set forth in claim 13, wherein resetting of the position of the abutment element is performed through a hollow in the base.

15. The rotary drive device as set forth in claim 1, wherein on displacement of the abutment unit into the positioning setting the two drive pistons are free of fluid pressure and are moved by the abutment unit.

16. A fluid power rotary drive device comprising:

a rotatably mounted output drive part having at least one ring of teeth;

a rack arranged on two juxtaposed drive pistons and being in engagement with the output drive part, the drive pistons being adapted to be oppositely moved by fluid actuation in two mutually parallel directions in order to cause a rotary movement of the output drive part between two end positions;

a position presetting device adapted to cooperate with the two drive pistons to permit presetting of an intermediate position of the output drive part, the position presetting device including an abutment unit having an actuating piston and two abutment parts supported on the actuating piston, the two abutment parts being arranged adjacent to each other in an axial extension of the two drive pistons, the abutment unit being adapted to be moved in relation to the drive pistons into a positioning setting in which the two abutment parts are simultaneously in contact with the respectively associated drive piston.

17. The rotary drive device as set forth in claim 16, wherein the actuating piston, as seen in cross section, possesses an elongated outline.

18. The rotary drive device as set forth in claim 17, wherein the two abutment parts are provided in the vicinity of the edge section on the narrow side of the actuating piston.

19. A fluid power rotary drive device comprising:

a rotatably mounted output drive part having at least one ring of teeth;

a rack arranged on two juxtaposed drive pistons and being in engagement with the output drive part, the drive pistons being adapted to be oppositely moved by fluid actuation in two mutually parallel directions in order to cause a rotary movement of the output drive part between two end positions;

a position presetting device adapted to cooperate with the two drive pistons to permit presetting of an intermediate position of the output drive part, the position presetting device includes an abutment unit having an actuating piston and two abutment parts supported on the piston, the two abutment parts being arranged adjacent to each other in an axial extension of the two drive pistons, the abutment unit being adapted to be moved in relation to the drive pistons into a positioning setting in which the two abutment parts are simultaneously in contact with the respectively associated drive piston wherein the abutment unit bears at least one actuating member cooperating with a position sensor.

* * * * *